United States Patent [19]

Wolk et al.

[11] 3,991,857

[45] Nov. 16, 1976

[54] ELEVATABLE PLATFORM FOR LOAD TRANSFER

[75] Inventors: Charles J. Wolk, Weingarten; Milton Osterman, St. Louis County, both of Mo.

[73] Assignee: Charles J. Wolk, Weingarten, Mo.

[22] Filed: Mar. 24, 1975

[21] Appl. No.: 561,667

[52] U.S. Cl. ..... 187/18; 254/122

[51] Int. Cl.[2] ..... B66F 3/22; B66B 11/04

[58] Field of Search ..... 187/8.71, 8.72, 18, 187/9 R, 1 R; 254/122, 120, 8 R, 8 B, 8 C, 9 R, 9 B, 9 C; 182/63, 69, 141

[56] References Cited

UNITED STATES PATENTS

| | | | |
|---|---|---|---|
| 2,862,689 | 12/1958 | Dalrymple et al. | 187/18 X |
| 2,937,852 | 5/1960 | Clarke | 254/122 |
| 3,032,319 | 5/1962 | Dale | 254/122 |
| 3,110,476 | 11/1963 | Farris | 187/18 X |
| 3,521,775 | 7/1970 | Vermette | 187/9 R X |
| 3,558,103 | 1/1971 | Lodige | 254/122 |

*Primary Examiner*—Evon C. Blunk
*Assistant Examiner*—James L. Rowland
*Attorney, Agent, or Firm*—Ralph W. Kalish

[57] ABSTRACT

A materials handling device which comprises an upper load-receiving plate, a lower base plate in planar parallel relationship to said upper plate, said upper plate being of greater dimension than said lower plate and having a depending marginal flange, a pair of first and second lever units interengaging said upper and lower plates, said lever units being in spaced-apart planar parallel relationship and being pivotally interconnected intermediate their lengths. Each lever unit comprises an inner and outer arm adapted at one of their ends for movement linearly with respect to one of said plates. Fluid operated members are associated with each lever unit and are operatively interconnected therewith by means of a cam provided linkage. Said upper plate has mounted thereon a pair of swingable ramps.

11 Claims, 12 Drawing Figures

G
14
15
13
12
5
A
25
9'
8
7
9
11
19
18
16
24
10'
22
21
23
20
17
6
4'
5'
6
51
40
42
26
3
4
2
27
28
4
117
116
46
50
45'
4
53
52
k
43
44'
46
53
39
38
118
51
49
L
30
31
32
34
33
38
50
46
44
1
45
46

7
25
9'
26
11
30
33
32
34
27
28
h
43
1
5'
6
29
42
40
41
35
36
37
39
38
g

ELEVATABLE PLATFORM FOR LOAD TRANSFER

BACKGROUND AND SUMMARY OF THE INVENTION

This invention relates in general to materials handling and, more particularly, to an elevatable platform for load transfer purposes.

There has been a continuing problem in transferring loads between relatively limited heights, such as, for instance, from the bed of a truck to ground level, or conversely. One solution which has had extensive usage has been the mounting of a hydraulically operated lift surface on the rear end of trucks, but which device is obviously useful only with the single vehicle involved. In situations wherein trucks are not so equipped, the receiving or loading dock or area must be equipped with means for transferring the load from one level to another and wherein the distances between said levels may vary.

Therefore, it is an object of the present invention to provide an elevatable platform assembly which is an independent entity for use in transfer areas for transmitting loads between vertically spaced-apart surfaces.

It is another object of the present invention to provide a device of the character stated which is adapted for accommodating varying heights so that the same is extremely versatile.

It is a still further object of the present invention to provide a device of the character stated which is so uniquely constructed as to be of a substantially relatively minimal height when in full lowered condition thereby in addition to facilitating movement of loads between same and the support surface, also conduces to storage in minimum space.

It is a still further object of the present invention to provide an elevatable platform for load transfer purposes which is mobile for ease of travel and for positioning into operating disposition.

It is another object of the present invention to provide a device of the character stated which incorporates a novel linkage system permitting of reliable and effective vertical movement of the platform.

It is a still further object of the present invention to provide a device of the character stated which is constituted of a simplicity of durable components so as to be resistant to breakdown and premit of hard usage; which may be most economically produced; which has a wide application in industry; and which requires minimal maintenance.

DESCRIPTION OF THE PREFERRED EMBODIMENT

Figure 1:
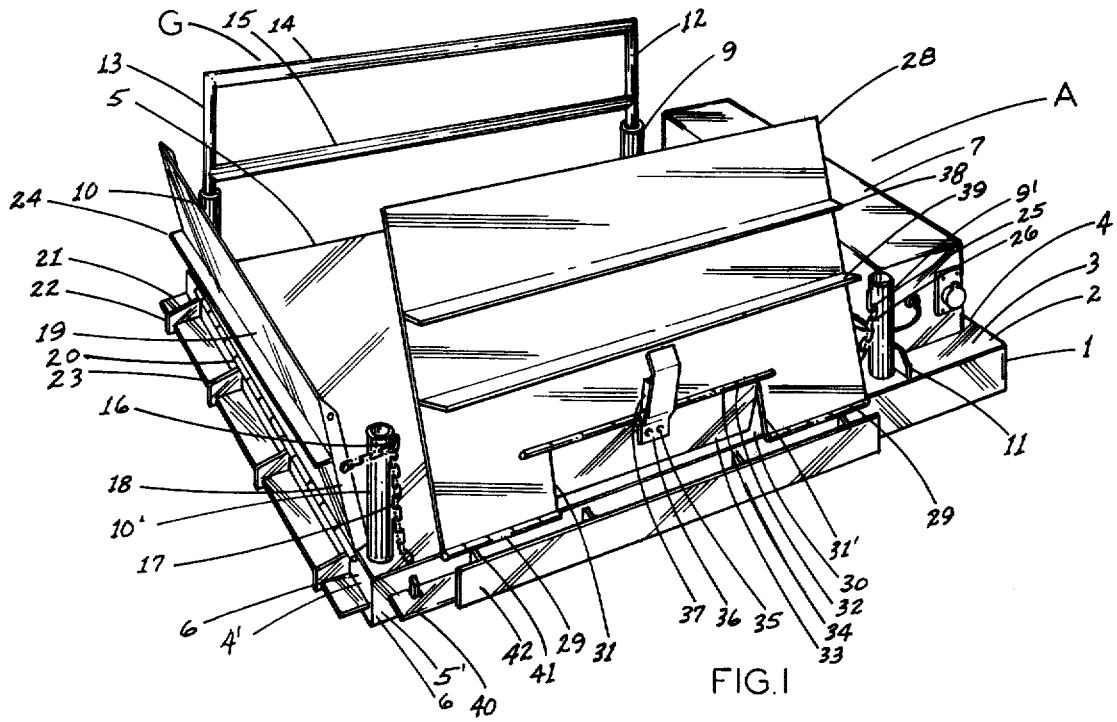
FIG. 1 is a top perspective view of an elevatable platform constructed in accordance with and embodying the present invention, illustrating the same in lowered condition and with the ramp disposed upwardly.

Referring now by reference characters to the drawings which illustrate the preferred embodiment of the present invention, A generally designates an elevatable platform assembly comprising, essentially a base 1, a load-receiving or upper platform 2, and a linkage system indicated generally L, to be described more fully hereinbelow for effecting movement of said platform 2 toward and away from base 1.

Figure 2:
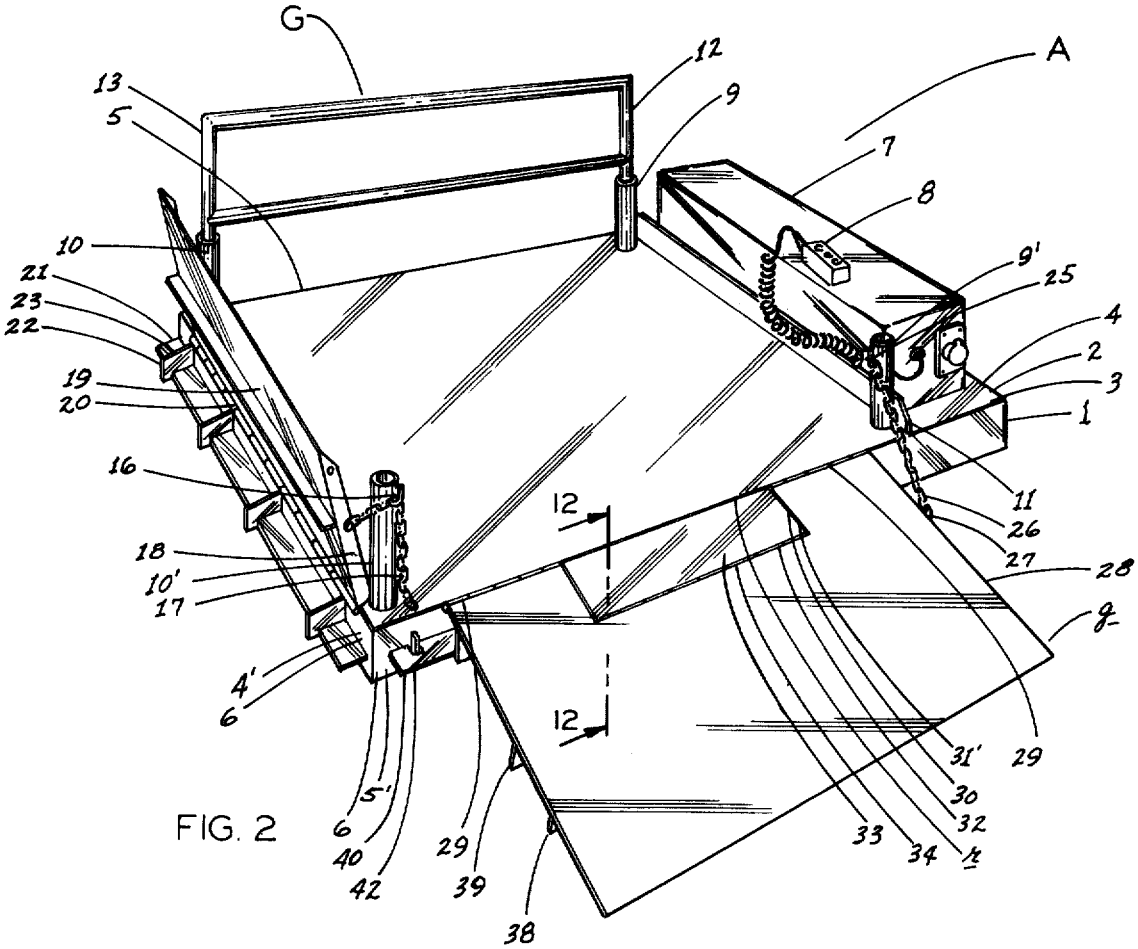
FIG. 2 is a top perspective view of the elevatable platform illustrating same in lowered condition and with the ramp in down position.
Figure 4:
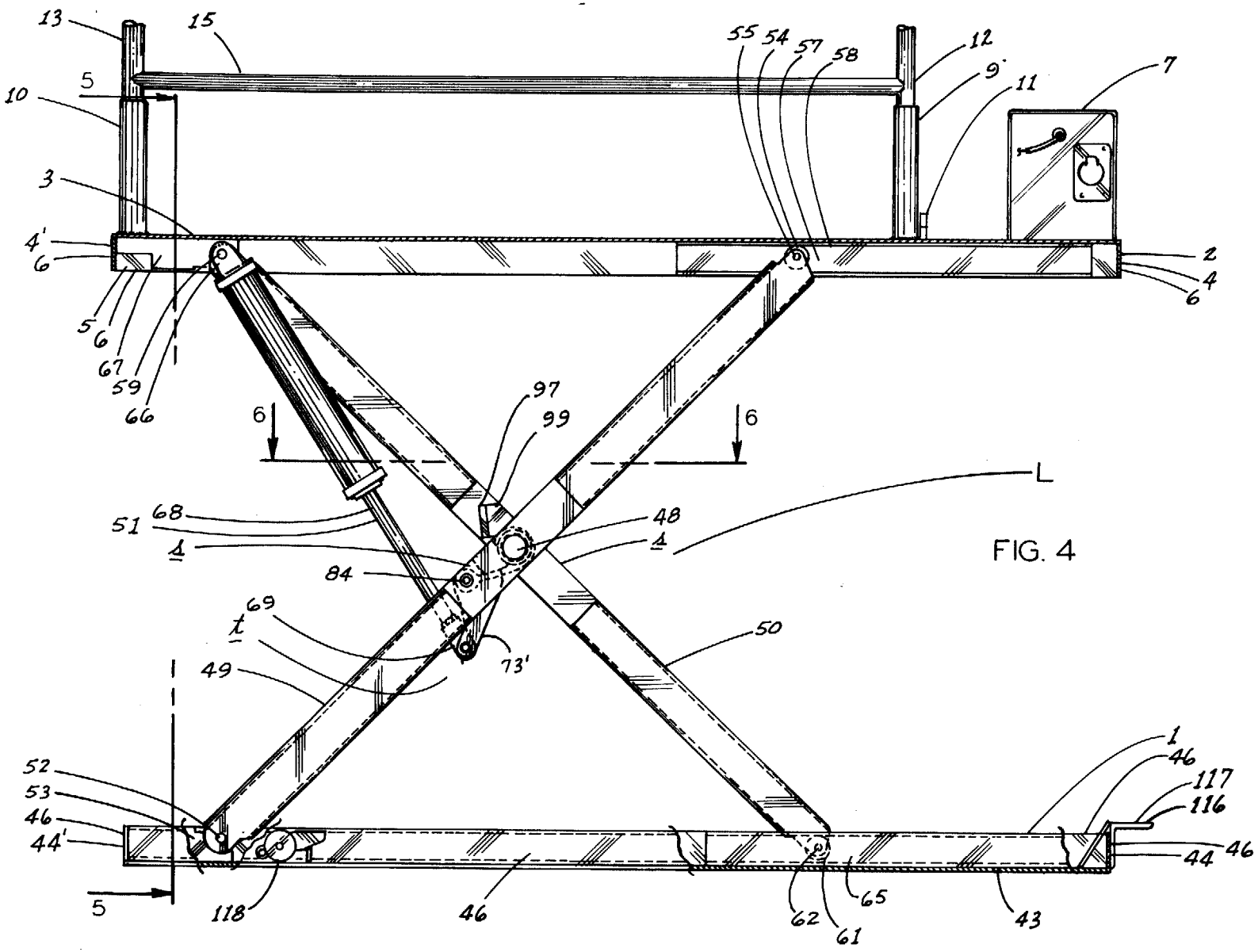
FIG. 4 is a side view in partial section taken on the line 4—4 of FIG. 3.
Figure 5:
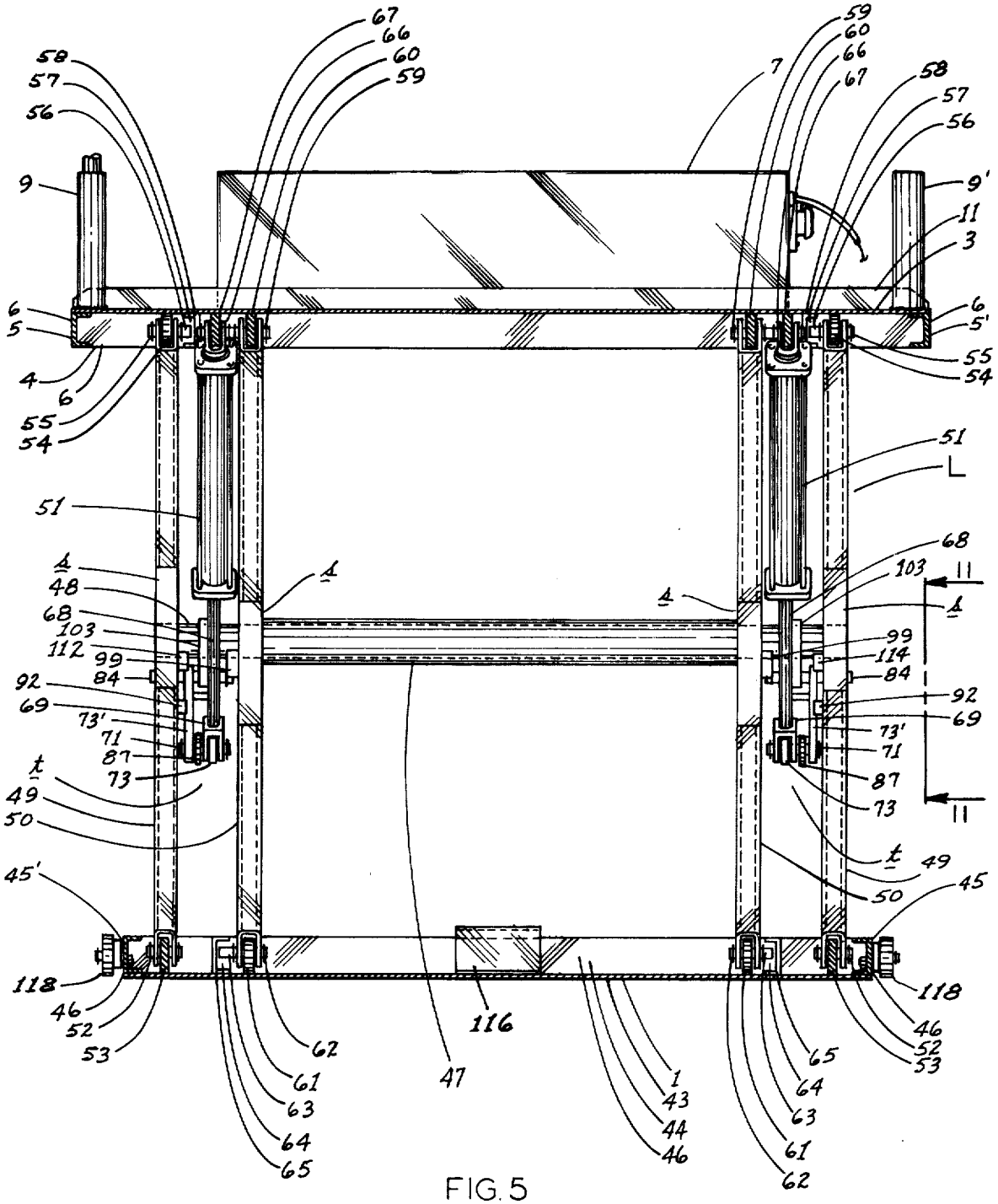
FIG. 5 is a vertical view in partial section taken on the line 5—5 of FIG. 4.

Platform 2 comprises a surface-defining plate 3, said plate being quadrilateral and having forward and rearward end edges 4,4' and opposed, parallel side edges 5,5'; there being a flange 6 depending from each of said plate edges whereby said upper platform 2 constitutes a shallow, downwardly opening receptacle, as may best be seen in FIG. 4. Mounted upon plate 3 adjacent, preferably, its forward end edge 4, is a housing 7 as for receiving fluid operating means, such as a pump, a fluid reservoir, a prime mover, and the like (not shown) there being a manually manipulable control unit 8 connected by suitable leads to the prime mover to allow an individual at a convenient location with respect to assembly A to effect operation thereof. The said pump and fluid system per se do not constitute a part of the present invention and are, hence, of standard character for effecting operation of fluid cylinders to be described more fully hereinbelow. Adjacent housing 7 and proximate side edges 5,5' of plate 3 are upstanding relatively short tubular posts 9,9', respectively, which are aligned with corresponding tubular posts 10,10' located adjacent rearward end edge 4' in its opposed end portions. Posts 9,9' may be interconnected by a transverse member 11 for rigidifying purposes, as well as to prevent any inadvertent contact between a load received on said plate and housing 7. Tubular posts 9, 10 are adapted to removably receive the lower end portions of vertical side elements 12,13, respectively, of a gate G having upper and lower cross members 14,15 respectively, extending between said side elements 12,13 with said cross member 15 being located upwardly of the lower ends of said elements permitting reception of the same within said posts 9, 10. Thus, it is obvious that gate G may be readily removed from engagement within said posts 9, 10, as by lifting, to permit of access to plate 3 across side margin 5. When received within said posts 9, 10, gate G constitutes a barrier for restraining any accidental displacement of a load upon plate 3 through that side thereof. Post 10' is provided with a hook, as at 16, for detachable interengagement with a length of flexible material, such as a chain 17, the outer end extremity of which is engaged to the proximate side flange 18 of a ramp 19 hingedly mounted as along its normally inner end edge to plate 3 along the rearward end edge 4' thereof, as by a piano-type hinge indicted at 20. Said ramp 19 is swingable between upper, non-operative position, as shown in FIGS. 1 and 2, and lower position wherein the same provides a roll-over surface for connecting the upper surface of plate 3 with a support surface, such as the floor or ground, as indicated generally *g*. Chain 17 is appropriately engaged upon hook 16 to maintain ramp 19 in its selected position. It will be observed that with ramp 19 in upper or inoperative position (FIGS. 1 and 2), the same will also constitute a barrier preventing any undesired shifting of a load received upon platform 2 in a direction toward the rearward end thereof.

Figure 3:
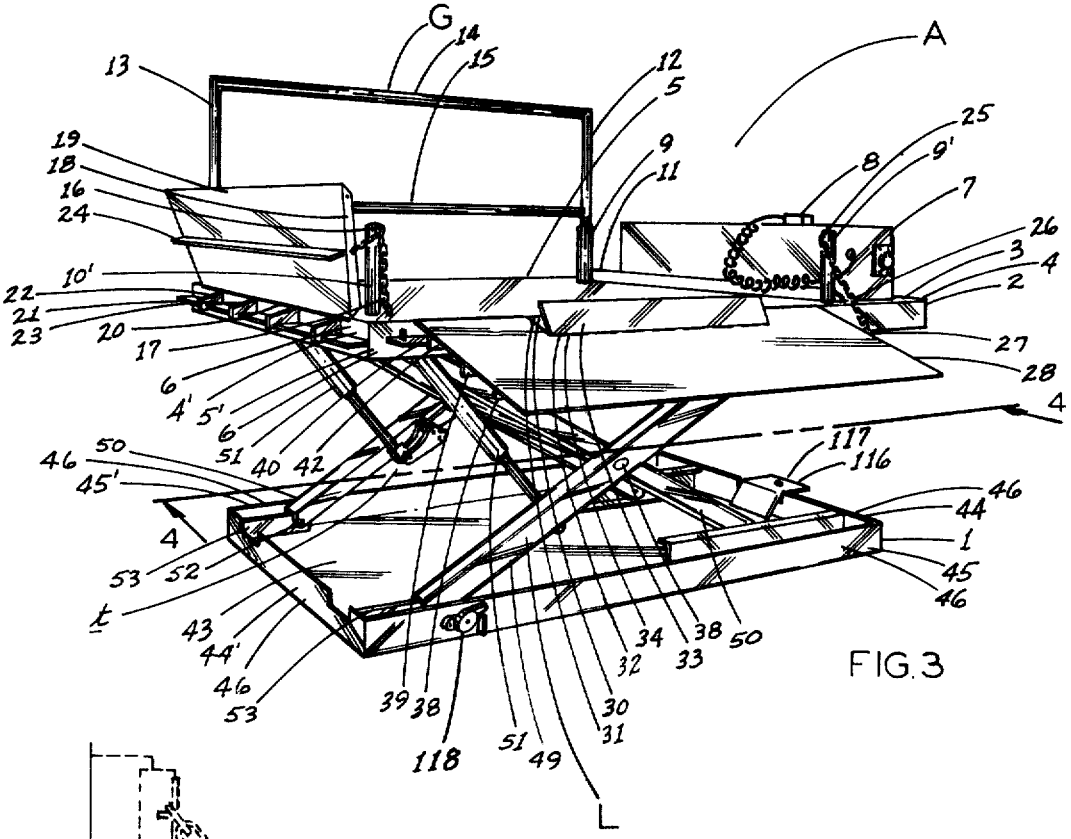
FIG. 3 is a perspective view of the elevatable platform in partially raised condition.
Figure 12:
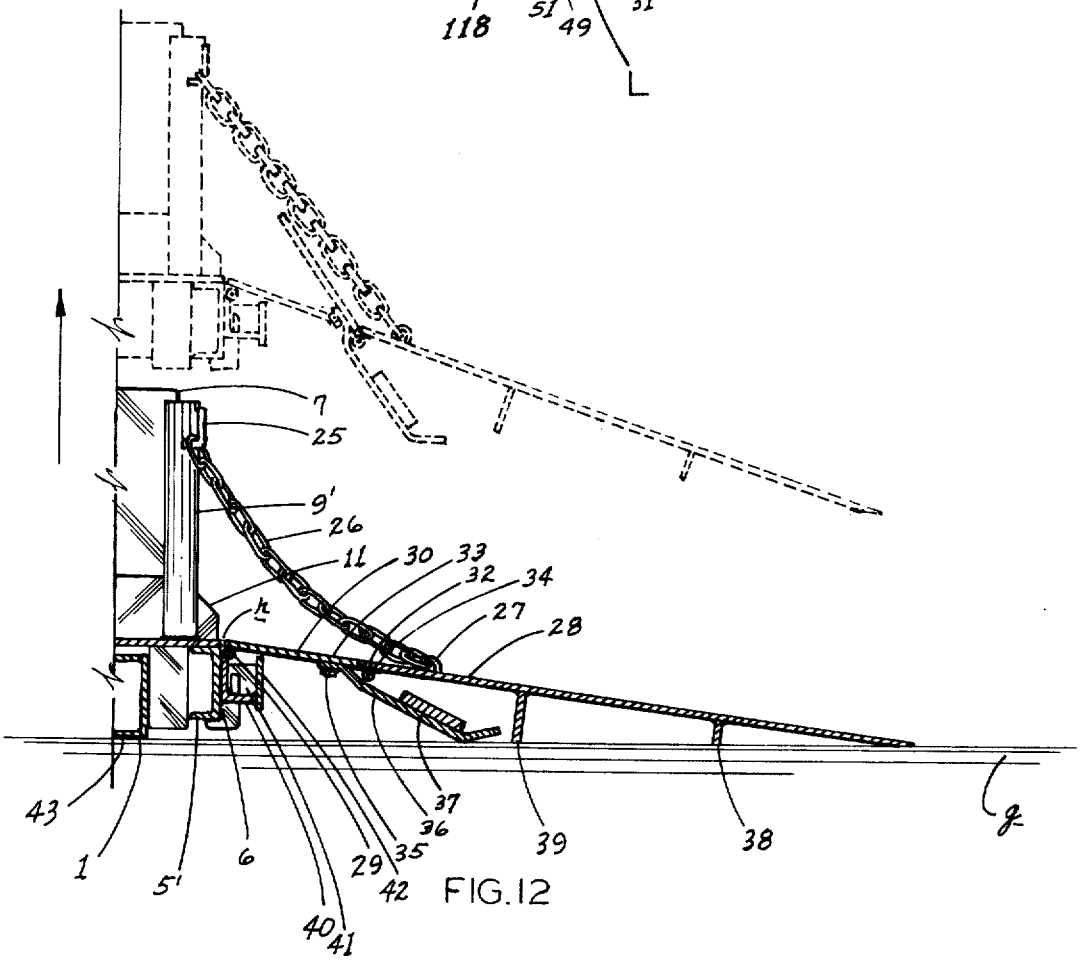
FIG. 12 is a vertical sectional view taken on the line 12—12 of FIG. 2.

Projecting from flange 6 along the rearward end of platform in substantially planar perpendicular relationship thereto is a narrow plate section 21 which throughout its length mounts a plurality of spaced apart, generally angle-shaped rests 22, the upper edges of which, as at 23, incline downwardly and outwardly and receive the lower end edge of a reinforcing flange 24 fixed to the under surface of ramp 19 and extend coextensively transversely thereof in its median zone. Thus, the said rests 22 provide a firm under support for ramp 19 when in lowered condition and with the angle of slope of edges 23 defining the limit of inclination of ramp 19 when lowered. Tubular post 9' is also provided near its upper end with a hook 25 for engaging a length of flexible material such as a chain 26, the outer end of which is fixed, as at 27, to the proximate side edge of a ramp 28. Said ramp 28 along its inner edge, as considered when in down position, or its lower edge, when considered in up or inoperative position, is swingably engaged to side edge 5' of platform 2 as by a piano-type hinge, indicated at 29. Said ramp 28 is provided centrally of its inner end portions with a rectangular aperture 30 having opposed side portions 31, 31' and a base edge 32 parallel to the intervening portion of the hinge rod, as at *r*. Provided within said recess 30 is a complementary plate 33 adapted for swingable movement with respect to the plane of ramp 28 along a pivot axis established by a hinge, as at 34, engaging same along its outer edge to base edge 32 of recess 30. Fixed centrally to the under surface of plate 33, as by bolts 35, is one end of an angulated arm 36 which extends beneath the adjacent portion of ramp 28 as considered with the said ramp in down position or outwardly thereof as viewed in upper inoperative position (FIG. 1) being spaced a sufficient distance from the confronting portion of ramp 28 for carrying a weighted member 37 which is of such weight as to counter the weight of plate 33 so that when ramp 28 is swung downwardly said weight 37 will cause plate 33 to swing upwardly about hinge 32 into the position shown in FIGS. 3 and 12 for the purpose of providing a wheel chock. Ramp 23, which is a relatively thin plate, is provided on its normally under-surface with a pair of spaced-apart transversely extending reinforcing sections 38, 39. Affixed to flange 6 beneath edge 5' is a narrow plate 40, the plane of which is substantially normal to that of said flange 6 and which plate 40, throughout its extent, mounts a plurality of spaced-apart spacers 41; said latter being planarwise perpendicular to said plate 40 as well as the adjacent portion of flange 6 to which the same are secured. On their outer vertical edges, said spacers 41 are welded or otherwise rigid with the inner face of an elongated support 42, the plane of which is substantially parallel to that of the adjacent portion of flange 6 and with its upper edge presented for underlying the inner end portion of ramp 28 when the same is in down or operative position (see FIG. 2) for buttressing same.

Base 1 comprises a flat plate 43 which is planarwise parallel to plate 3 and in registration therewith, although of relatively reduced dimensions for purposes presently appearing; said plate 43 having front and rearward end edges 44, 44' and parallel side edges 45,45' with there being a continuous upstanding flange 46 thereabove. Flange 46 is of slightly less height than flange 6 of platform 2 so that when elevatable platform assembly A is in lowered or operative condition (see FIGS. 1 and 2) said base 1 will be received within platform 2, which latter thus serves as a receptacle, conducing to maximum compactness of assembly A when lowered. Accordingly, by means of its configuration, base 1 constitutes, in effect, an upwardly opening box-like member, with platform 2 constituting a cover therefor.

Linkage L, which interconnects base 1 and platform 2, comprises a pair of lever units *t* which are located at opposite sides of assembly A within the volume defined by the registering base 1 and platform 2. Said lever units *t* are interconnected by a sleeve 47 extending transversely of assembly A within which sleeve there is mounted a shaft 48; whereby said lever units *t* are adapted to operate in unison; such interconnection being more explicitly described hereinbelow. Since each of the lever units *t* are of like construction, only one such unit will be described, but with the recognition of the aplicability of such description to the other or remaining unit *t* so that like components will be identified by the same reference characters.

Each lever unit *t* comprises a pair of outer and inner lever arms 49, 50 which are disposed transversely of assembly A spaced apart a limited distance to accommodate a fluid cylinder 51 therebetween. Said lever arms 49, 50 may be of tubular character as of box-form in cross section for strengthing purposes and are illustrated herein as comprising a central solid section as at *s*. Outer arm 49 at its rearward end is hinged by a pin 52 to the forward end of a short bar 53 fixed on plate 43 and having its rearward end rigid with the adjacent portions of flange 46; said bar 53 having its axis parallel to the longitudinal axis of base plate 43. At its other or forward end, outer lever arm 49 is provided with a roller 54 for engaging the undersurface of plate 3; said roller 54 being carried on a shaft 55, one end of which projects inwardly of arm 49 for mounting a guide roller 56 which is received within a guideway 57 defined by a laterally outwardly opening channel member 58 extending lengthwise of upper platform 2 and being fixed to the underface of plate 3. The forward end of channel 58 is rigid with the confronting forward end portion of flange 6. Roller 54 is thus presented for contact with the under face of plate 3 with guide roller 56 controlling the direction of traverse and conducing to maintenance of contact between said plate 3 and roller 54. Inner lever arm 50 at its rearward end is pivotally engaged by a pin 59 upon the rearward end of a relatively short bar 60 rigid with the under-surface of upper platform plate 3 in its rearward portion, said bar 60 being welded or otherwise fixed at its rearward end to the adjacent portion of flange 6. Inner arm 50 at its opposite or forward end carries a roller 61 for engagement with the upper face of base plate 43, said roller being mounted upon a short shaft 62 which, at its outer end projects beyond inner lever arm 50 to carry a guide roller 63, which latter is accepted within a guideway 64 defined by a channel section 65 fixed or otherwise secured upon the upper surface of base plate 43 and with its forward end rigid with the forward portion of base flange 46.

Pin 59 extends outwardly of inner lever arm 50 for projection through openings (not shown) in the aligned arms of a clevis 66 provided at the upper end of cylinder 51 and through the registering opening (not shown) in the forward end of a mounting bar 67 which is received between the arms of said clevis 66. Mounting bar 67 is rigid with the under-surface of upper platform plate 3 and of like extent and parallel to short bar 60. Thus, cylinder 51 which may be of the hydraulic or pneumatic type is swingably mounted to upper platform plate 3 by means of mounting bar 67. At its other or forward end cylinder 51 is provided with a piston 68 which latter, at its cylinder remote end, carries a clevis 69 having aligned openings in the arms thereof, as at 70, 70', to serve as bearings for a shaft 71 which projects beyond clevis arm 70', terminating immediately inwardly of outer arm 49. Intermediate clevis arms 70, 70', shaft 71 extends through an opening 72 formed at the rearward end of an inner control plate 73 having a bottom edge 74 with a relatively short slightly angulated portion 75 which terminates in a short upwardly extending section 76, the upper end of which provides one limit of a linear cam operating edge 77, the upper end of which latter terminates at the base of an arcuately rounded portion 78. Rearwardly of said rounded portion 78 plate 73 is contoured to present a shot rectilinear portion 79 tangential to arcuate portion 78 and, thence, includes as along angle 30° to the longitudinal axis of plate 73, as at 80, and therefrom presents an edge portion 81 substantially parallel to bottom edge 74 for merging about a rounded end, as at 82. Concentric with the arcuate portion 78 control plate 73 is apertured, as at 83, to provide a bearing for a shaft 84 which is slightly parallel to a companion shaft 85 journaled in a bearing-forming opening 86 in the adjacent portion of control plate 73 proximate cam operating edge 77.

Outwardly of control plate 73 shaft 71 mounts a roller 87 and outwardly thereof, in its outer end portion, said shaft is journaled in an opening 88 of an outer control plate 73' (FIG. 9) which is of like contour, size, and character as inner control plate 73 so that like reference numerals will designate corresponding components of said control plates 73, 73'. On its outer end extremity, shaft 71 lock carries a lock ring 89 with there being a similar lock ring 90 on the inner end of said shaft 71. To maintain inner and outer control plates 73, 73' in spaced-apart relationship, there is provided a spacer 91 therebetween which is welded to the confronting central portions of said plates 73, 73', being of generally triangular configuration, and located between roller 87 at one end and shafts 84, 85 at its other end (see FIGS. 8 and 9).

Figure 6:
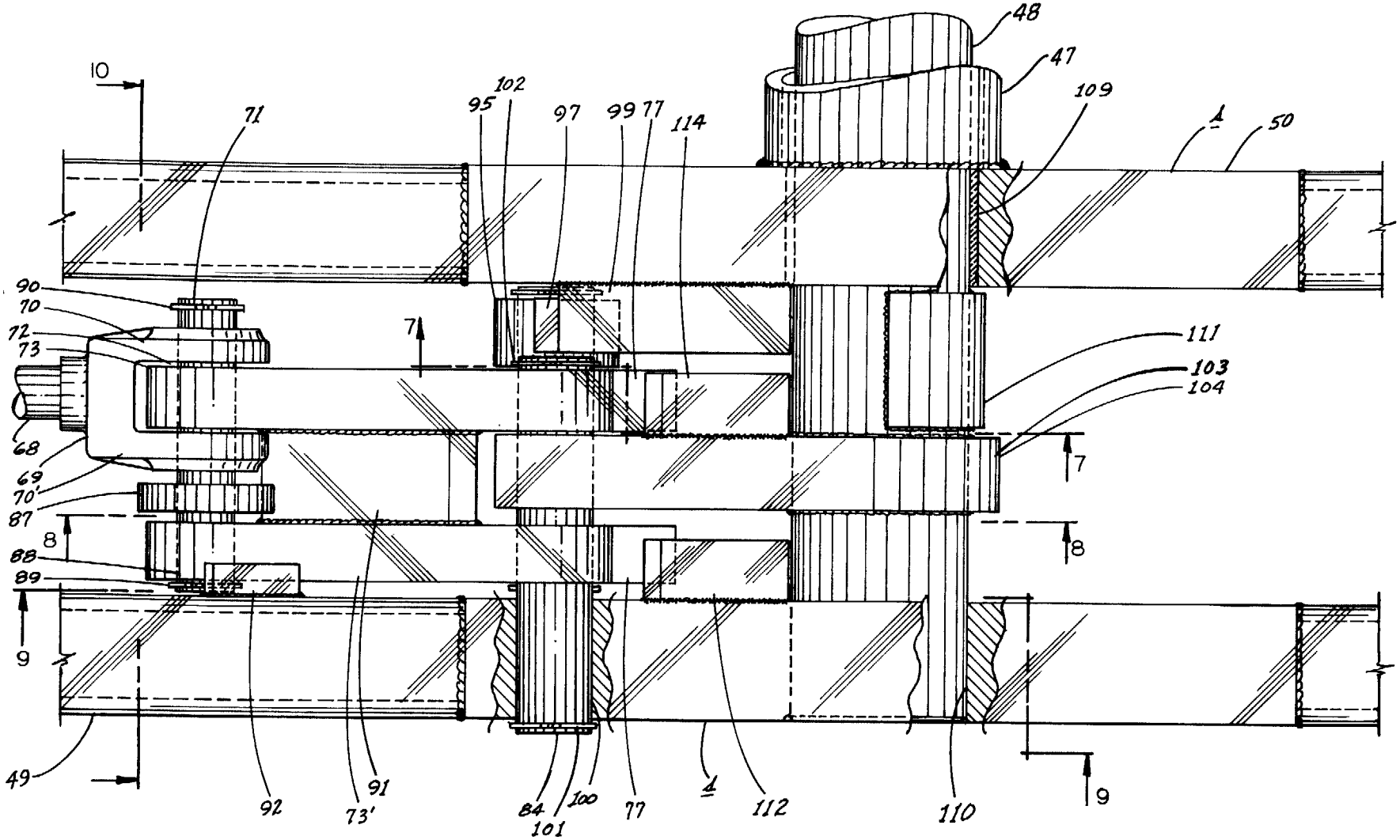
FIG. 6 is a sectional view taken on the line 6—6 of FIG. 4.
Figure 7:
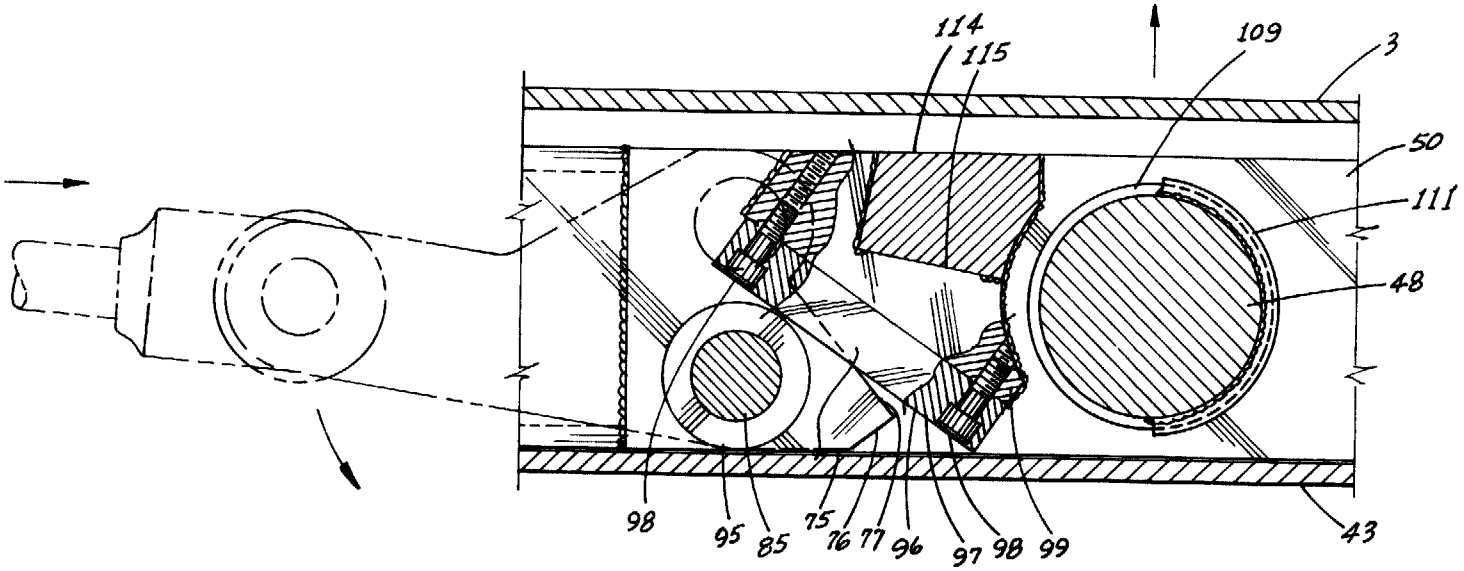
FIG. 7 is a vertical sectional view taken on the line 7—7 of FIG. 6.
Figure 10:
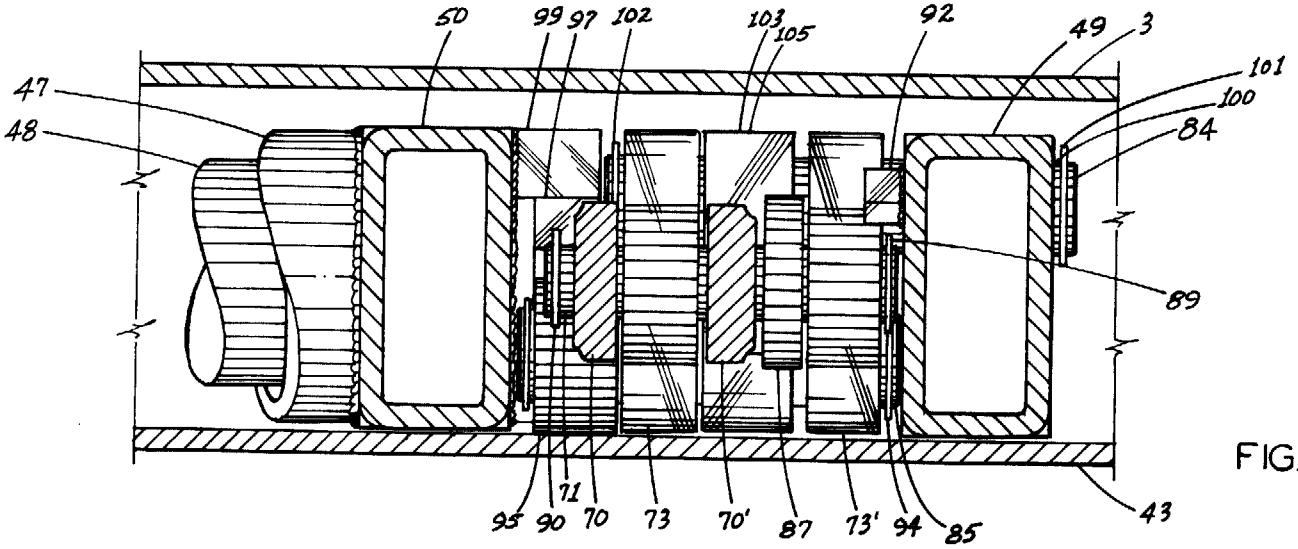
FIG. 10 is a vertical sectional view taken on the line 10—10 of FIG. 6.
Figure 9:
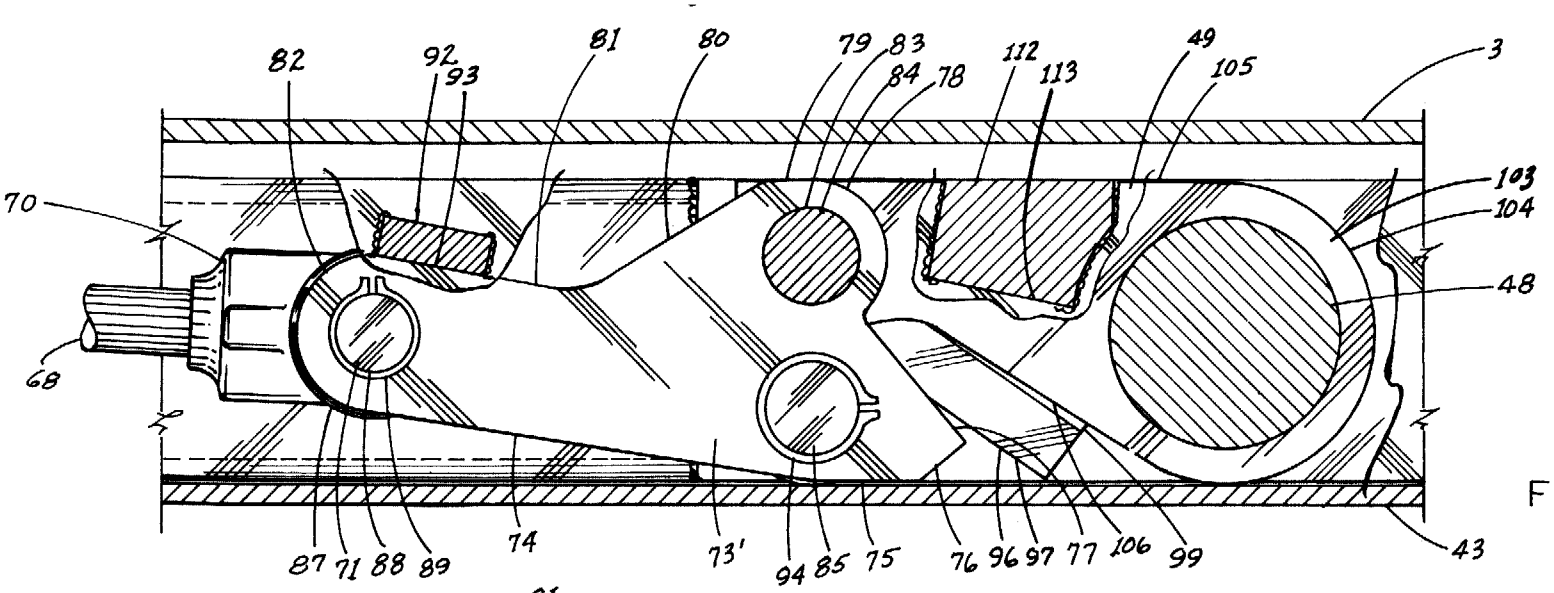
FIG. 9 is a vertical sectional view taken on the line 9—9 of FIG. 6.
Figure 8:
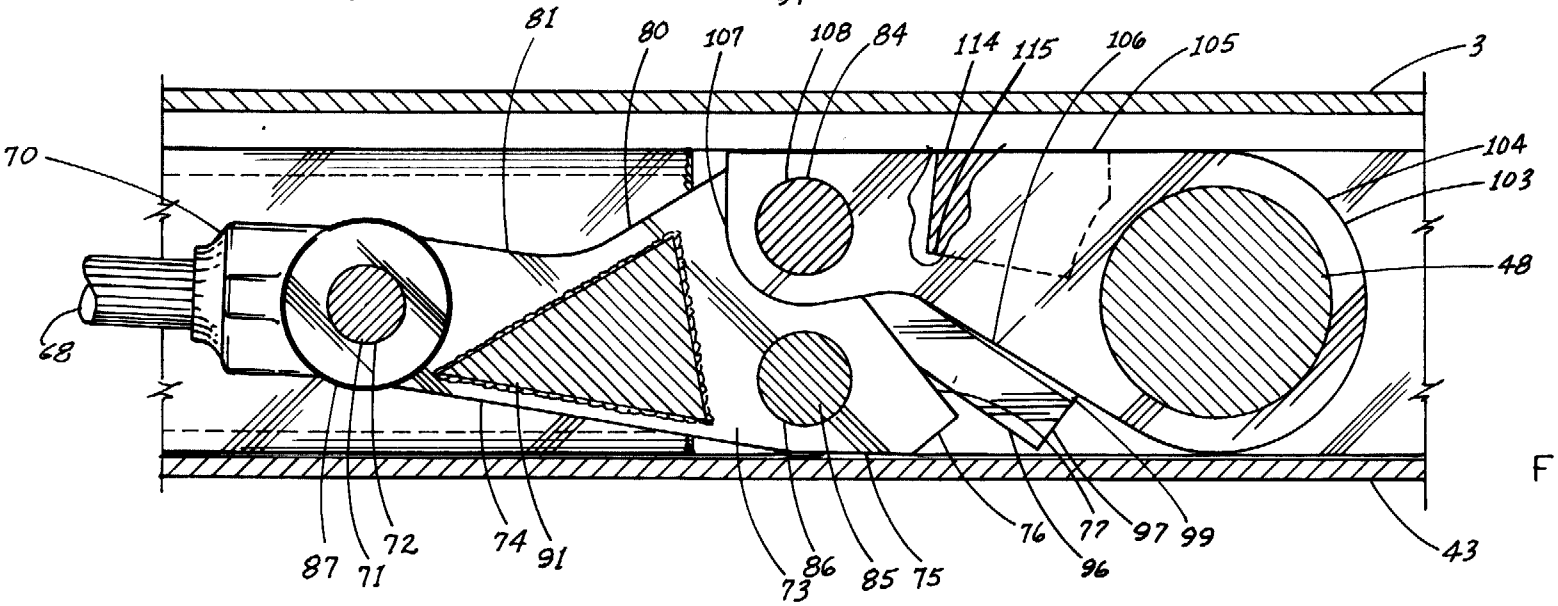
FIG. 8 is a vertical sectional view taken on the line 8—8 of FIG. 6.

Fixed on the inner face of outer leg 49 is an abutment or detent 92 being so disposed as to present its normally under face 93 in overlying confronting relationship to edge portion 81 of the adjacent outer control plate 73' when said platform assembly A is in collapsed or inoperative condition (see FIGS. 6, 9, 10). Shaft 85 is journalled within the bearings 83 of control plates 73, 73' and with its outer end projecting immediately outwardly of control plate 73'but being spaced inwardly of outer leg 49 and carrying a lock ring 94 on such end. At its other, or inner end, shaft 85 extends beyond inner control plate 73 but terminates immediately outwardly of inner leg 50 and upon such projecting block 97 mounted as by screws 98 upon a boss 99 welded or otherwise fixed to the outer side face of inner leg 50. With particular reference to FIGS. 7 and 8, it will be seen that with assembly A in collapsed or inoperative condition, said cam surface 96 wll be upwardly and rearwardly inclined with respect to the plane of base plate 3 at an angle of approximately 30°.

Shaft 84 is journaled in the bearings 83 of inner and outer control plates 73, 73' and extends beyond said latter control plate into a bearing, as indicated at 100, formed in outer lever leg 49. Immediately outwardly of the outer face of outer lever leg 49, shaft 84 mounts a lock ring 101 and carries a similar lock ring 102 on its inner end adjacent the inwardly directed face of control plate 73 (see FIGS. 6 and 10). Engaged to shaft 84 between control plates 73, 73' is the rearward end of a connector plate 103 (see FIGS. 6 and 8) contoured to provide an enlarged arcuate forward end portion 104, concentric with shaft 48, upon which said arcuate portion is welded or otherwise fixed. The normally upper edge of connector plate 103, as at 105, is rectilinear being tangential to arcuate portion 104 and in alignment with the upper edge of base flange 46 when said assembly is in collapsed or inoperative condition (FIG. 9). The major portion of the lower edge of connector plate 103 is also rectilinear, as at 106, being also tangential to arcuate portion 104 but along an axis to edge 105 at an angle of less than 90°; with the rearward end constituting a boss 107 containing the bearing 108 for shaft 84.

With particular reference to FIG. 6 it will be seen that shaft 48 in its end portions projects through a bearing 109 provided substantially intermediate the length of inner lever leg 50 and at its outer end extremity is structurally press fitted within an opening 110 formed in outer lever leg 49. Fixed on shaft 48 between inner leg 50 and connector plate 103 is a spacer element 111 for preventing any undesired axial shifting of shaft 48.

As pointed out above, sleeve 47 which is of relatively increased diameter with respect to shaft 48 interconnects lever units *t* by virtue of being fixed, as by welding, at its ends to the inwardly directed, confronting portions of the inner legs 50 of said units thereby tying same together. As may best be seen in FIG. 6, shaft 48 freely extends through said sleeve 47 and in effect interengages the outer lever legs of the two lever units *t*.

Fixed on the inner face of outer lever arm 49 immediately adjacent shaft 48 and spacedly from abutment 92 is a cam 112, the normally under face 113 of which provides an operating surface for camming relationship with operating edge 77 of outer control plate 73'. A similar cam 114 is fixed upon the inwardly directed face of connector plate 103 for like relationship of its under face 115 with the operating edge 77 of inner control plate 73 (see FIGS. 6, 7, 8).

There may be provided upon base 1 at its forward end an angle shaped member 116 for a horizontaly projecting portion 117 apertured for suitable engagement to a towing connection; an with there being wheels 118 mounted on each side of said base flange 46 in its rearward portion for facilitating the immobility of assembly A under tow. Said wheels 118 may be adapted for movement between operative and inoperative position in accordance with common practice, so that when assembly A is in position for operation the same will be firmly disposed flatwise upon the particular support surface *g*.

In usage, elevatable platform assembly A is designed to facilitate the transfer of loads between vertically spaced apart surfaces, such as, for instance, between a truck bed and a permanent loading surface, such as a loading dock. Thus, said assembly A obviates the necessity of a permanently installed, swingably mounted dock ramp on the loading dock. By means of the mobility of assembly A, such can be shifted to any location or operation thereby providing a versatility which cannot be accomplished by rigid, truck-receiving docks. It is apparent that assembly A may be adapted for any selected range of elevation and therefore is adapted for bridging the varying distances encountered between unloading and loading surfaces. As will be shown hereinbelow, assembly A by reason of its novel relation may be collapsed into a most compact condition when in lowered position, wherein base plate 43 and upper plate 3 may be spaced apart a distance of about 4½ inches thereby permitting lowering of the received load into immediate proximity to the support surface, in which condition platform 2 effectively telescopically receives base 1. Despite such compactness, linkage L may be designed to extend to meet suitable height, but normally one of 4½ feet has proved adequate for customary usage.

By virtue of wheels 118 assembly A in closed or lowered state, may be pulled to a position immediately adjacent the unloading end of a truck with its end edge 41 confronting same, and by suitable operation of control unit 8, linkage L will be caused to extend, in a manner to be more fully described below, to elevate plate 3 into substantially coplanar relationship with the truck bed. Ramp 19 is then lowered or dropped at it were, to bridge the intervening distance, providing a roll-over surface. The load is then transferred from the truck bed onto plate 3 as by a dolly or the like, and thereafter ramp 19 is returned to raised condition, and upper platform 2 is caused to descend through suitable operation of control unit 8 with resultant contraction of linkage L. When assembly A is thus in down or lowered condition and the truck has been removed, ramp 19 may be swung downwardly and the load moved thereover onto the ultimate receiving surface. If the truck has not been moved, then ramp 28 may be utilized for travel of the loads thereon to the support or ultimate receiving surface and, obviously if need be, and the load is amenable, transfer may be effected through side 5 by withdrawal of gate G.

Ramp 28 is particularly useful with fork lift trucks when engaged for moving a load onto plate 3. For such purpose, when assembly A is in down position, ramp 28 is lowered (as shown in FIG. 2) to provide a suitable roll-over surface between the support surface and plate 3. With the fork lift truck disposed upon plate 3 linkage L will be operated to elevate platform 2 and during such elevation ramp 28 will tend to swing downwardly causing arm 36 to be brought into engagement with support 42 resulting in swinging of said arm 36 about hinge rod *r* so that plate 33 is pivoted thereby upwardly to provide a wheel chock for inhibiting unauthorized travel of the fork lift truck from plate 3 during elevation or descent of platform 2. The weighted member 37 on arm 36 assures of maintaining said arm in such operative condition. The ramp 28 may be maintained in a lowered state during movement of assembly A between upper and lower condition.

From the foregoing it will be seen that assembly A is of extreme versatility, actually presenting three edge portions namely 5, 5', and 4' for ready accessibility to loads to be removed from said assembly A or to be accepted thereon. Furthermore, as pointed out above, assembly A eliminates any need for the costly installation of permanent loading docks or expensive hydraulically, pneumatically, or mechanically operated loading ramps as have been widely used prior to the present invention.

As will now be more fully described, linkage L is unique in the particular arrangement and inter-relationship of its components to permit of the compactness of assembly A when in downwardly or collapsed condition. Heretofore, despite numerous efforts, there has not been achieved the maximum compactness of the present invention as the upper and lower plates have necessarily been in spaced apart relationship when collapsed with undesired access between the base and upper portion. Admittedly, the compactness of the present invention facilitates movement of loads between the particular vertical surfaces as well as being promotive of ready transportability of assembly A.

Turning now to FIGS. 7, 8, and 9, it will be seen that with assembly A in collapsed condition, lever arms 49, 50 of each lever unit *t* will be in axially parallel relationship and received on their under surfaces upon the upper face of base plate 43 with rollers 54, 61 being at the forward limits of their respective guideways 57, 64. The related fluid cylinder 51 will thus also be in substantialy axially parallel relationship to the adjacent lever arms 49, 50 and with the entire linkage L snugly received within said plates 43, 3. The under faces 93 of abutments 92 will engage the upper edge portions 81 of adjacent outer control plate 73' (see FIGS. 6 and 9) with cam follwer rollers 95 abutting in their upper forward portions against the confronting upper portion of cam surfaces 96 (see FIG. 7). Operating edges 77 of control plates 73, 73' are in downwardly spaced relationship to the under-faces 113, 115 of cams 112, 114, respectively. In order to effect elevation of upper plateform 2 control unit 8 is manipulated to cause fluid to be delivered to the fluid cylinders 51 (the lines or conduits for which are not illustrated) and thereby cause piston 68 to extend. Such latter will initially cause corresponding forward travel of the interconnected control plates 73, 73' and with roller 95 being moved reltively along cam surface 96 causing a lifting force to be thereby imparted to associated arm 50 with which the boss 99 is rigid; there being attendant rearward travel of rollers 61 within guideways 64 promoting swinging of the associated lever units *t*. Cam surface 96 will, by reason of its normal inclination, concurrently apply a downward force on cam follower roller 95 to cause same to maintain contact with the upper surface of plate 43 at it effects its lifting action so that roller 87 will be urged into contact with plate 3. Such downward force will tend to maintain control plates 73, 73' against upward swinging at their rearward ends and thus allow control plate 73' to move forwardly beneath abutment 92 so that swinging is prevented until control 73' has cleared said abutment 92 at which point operating edges 77 of control plates 73, 73' will be brought into engagement with under-faces 113, 115 of cams 112, 114 with consequent development of the rocking action initiated by rollers 95 and cam surfaces 96.

Figure 11:
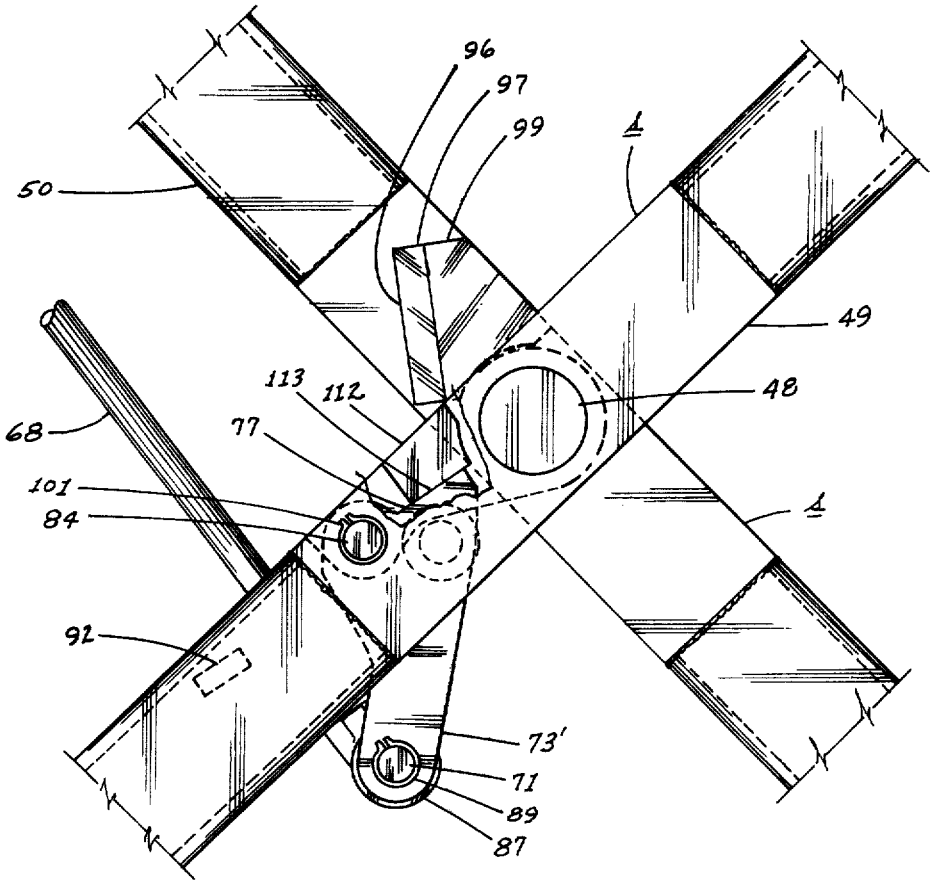
FIG. 11 is a partial side view taken on the line 11—11 of FIG. 5, illustrating the linkage with the platform in fully raised condition.

As lever arms 50 tend to swing upwardly with their rollers 61 moving rearwardly, and with control plate 73' thus being clear of the normally restraining effect of abutment 92, such upward swinging will carry with it, as it were, the upper ends of cylinders 51 so that the direction of force of piston 68 will assume a vertically inclined attitude. The contact between operating edges 77 and cams 112, 114 will thus bring about the continued lifting action of lever units *t* with said control plate 73, 73' thus being swung upon shafts 71 into the position shown in FIGS. 4 and 11. As the lifting action continues with outer arms 49 being similarly rocked so that rollers 54 are travelling rearwardly within the respective guideways 57. Both lever units *t* will, of course, act in unison by reason of their mutual maners of securement to shafts 48 and sleeves 47. In fully extended condition, it is obvious that contact will have been lost between roller 95 and cam surface 96 but firmed reliable contact will at all times be maintained between said operating edges 77 and the related cams 112, 114 with pistons 68 in hibiting any inadvertent loss of contact. Thus, with assembly A fully extended (as shown in FIG. 4) the device is firm and stable against premature collapsing.

When it is desired to lower assembly A, piston 68 is withdrawn which will obviously cause an upward movement in its lower end so as to swing control plates 73, 73' allowing shaft 48 and the lever units to descend with rollers 54, 61 travelling forwardly within their respective guideways and thereby assisting in the downward swinging of said lever units *t* to bring about collapsed condition. It is apparent that assembly A may be stopped at any point within the limits of its upward or downward travel since its operating edges 77 at all times maintain fluid supported contact with cams 112, 114.

Having thus described our invention what we claim and desire to obtain by Letters Patent is:

1. A materials handling device comprising an upper load-receiving plate, a lower base plate in planar parallel relationship to said upper plate, a pair of first and second lever units spaced apart transversely of said device and interengaging said upper and lower plates for movement of the upper plate toward and away from said lower plate, each of said first and second lever units comprising an outer arm and an inner arm, thereby being a transverse sleeve-forming member connecting the inner arms of said lever units substantially intermediate their length, each inner arm having a bearing opening in registration with said sleeve-forming member, a main shaft progressing through said sleeve-forming member and being journalled within said bearing openings in said inner arms and with the outer portions of said main shaft extending beyond the inner arms and interconnectingly engaging said outer arms substantially intermediate their length, said inner and outer arms of each lever unit being pivotally engaged at one of their ends to one of said plates and at their opposite ends being slidably engaged with the other of said plates, a fluid cylinder interposed between the outer and inner arms of each lever unit, means pivotally engaging each fluid cylinder at one end to said upper plate, a piston engaged within each cylinder for movement toward and away from same at its opposite end, and means operatively connecting said piston in its cylinder-remote portion with said main shaft, and first and second cam means operatively connecting each piston with the outer and inner arms, respectively, of the related lever unit.

2. A materials handling device as defined in claim 1 and further characterized by said upper plate being of greater area than said lower plate, said upper plate having a depending peripheral flange for disposition outwardly of the adjacent portions of the lower base plate when said upper plate has reached the limit of movement toward said lower plate.

3. A materials handling device as claimed in claim 1 and further characterized by said upper plate being quadrilateral having a forward end, a rearward end, and parallel side edges, a first ramp swingably mounted on one of said side margins.

4. A materials handling device as defined in claim 3 and further characterized by means provided on said upper plate for limiting the downward swinging movement of said first ramp.

5. A materials handling device as defined in claim 1 and further characterized by said first and second cam means being spaced apart transversely of said device, said means operatively connecting each piston with said main shaft being disposed intermediate the associated first and second cam means.

6. A materials handling device as defined in claim 5 and further characterized by a first shaft in each lever unit, means engaging the cylinder remote end of each piston upon the associated first shaft, first and second planarwise parallel control plates having rearward end portions engaging each first shaft, means engaging said first and second control plates with the outer arm of the associated lever unit, said first cam means comprising a cam following surface in the forward end portion of the related outer control plate, and a cam cooperating with said surface fixed on the associated outer arm.

7. A materials handling device as defined in claim 6 and further characterized by said means connecting the related inner and outer control plates with the associated outer arm being a second shaft, there being bearing openings in the upper forward portions of said inner and outer control plates and in the related outer arm for journalling of said second shaft therein.

8. A materials handling device as defined in claim 7 and further characterized by said means operatively connecting each piston and said main shaft comprising a connector plate between the associated inner and outer control plates, said connector plate having a forward end portion fixed on said main shaft and a rearward portion engaged upon the related second shift, a cam fixed on the inwardly directed side of each connector plate, and a cam following surface provided on the forward end portion of the adjacent inner control plate engageable with said last mentioned cam.

9. A materials having device as defined in claim 8 and further characterized by each lever unit having a third shaft axially parallel with said second shaft, the inner and outer control plates and connector plate of each lever unit in the lower forward end portions engaged upon the related third shaft, each third shaft projecting at its inner end inwardly of the adjacent inner control plate, said second cam means of each lever unit comprising a cam follower mounted upon the inner end of the related third shaft, and a cam surface fixed on the associated inner arm and engageable with said cam follower.

10. A materials handling device as defined in claim 9 and further characterized by a roller engaged upon each first shaft between the adjacent inner and outer control plates.

11. A materials handing device as defined in claim 10 and further characterized by an abutment cam mounted upon each outer arm in confronting relationship to the adjacent outer control plate for detaining engagement therewith when the upper plate is in lowered or in inoperative condition.

* * * * *